US005361419A

United States Patent [19]

Bernstein

[11] Patent Number: 5,361,419

[45] Date of Patent: Nov. 8, 1994

[54] HELMET WITH SOUND DUCTS

[75] Inventor: Lawrence A. Bernstein, Malibu, Calif.

[73] Assignee: Protector Development, Malibu, Calif.

[21] Appl. No.: 760,527

[22] Filed: Sep. 12, 1991

[51] Int. Cl.[5] ..... A42B 1/08

[52] U.S. Cl. ..... 2/423; 2/425; 2/209

[58] Field of Search ..... 2/410, 423, 424, 425, 2/422, 171.3, 6, 411, 414, 6.1, 6.2, 6.6, 416; 455/351; 181/175, 196, 198, 0.5

[56] References Cited

U.S. PATENT DOCUMENTS

| | | | |
|---|---|---|---|
| 2,889,555 | 2/1957 | Stuart et al. | 2/425 |
| 4,054,953 | 10/1977 | De Barsey | 2/425 X |
| 4,115,874 | 9/1978 | Hasegawa | 2/425 |
| 4,370,758 | 2/1983 | Mattheis | 2/410 |
| 4,519,099 | 5/1985 | Kamiya et al. | 2/410 |
| 4,555,816 | 12/1985 | Broersma | 2/424 X |
| 4,586,197 | 5/1986 | Hubbard | 2/425 X |
| 4,622,700 | 11/1986 | Sundahl | 2/410 |
| 4,627,115 | 12/1986 | Broersma | 2/425 |
| 4,653,123 | 3/1987 | Broersma | 2/425 |
| 4,665,569 | 5/1987 | Santini | 2/411 X |
| 4,667,348 | 5/1987 | Sundahl | 2/410 |
| 4,698,856 | 10/1987 | Arai | 2/425 |
| 4,700,411 | 10/1987 | Kawasaki et al. | 2/425 |
| 4,704,746 | 11/1987 | Nava | 2/424 |
| 4,729,132 | 3/1988 | Fierro | 2/425 X |
| 5,097,538 | 3/1992 | Feuling | 2/425 |

FOREIGN PATENT DOCUMENTS

| | | | |
|---|---|---|---|
| 7406185 | 9/1975 | France | 2/414 |

*Primary Examiner*—Clifford D. Crowder
*Assistant Examiner*—Larry D. Worrell, Jr.
*Attorney, Agent, or Firm*—Poms, Smith Lande & Rose

[57] ABSTRACT

A helmet for use with a bicycle, motorcycle or other vehicle. In one embodiment, a duct is located at each side of the helmet, and used for the dual functions of drawing air from the interior of the helmet and channeling ambient sounds inside the helmet where the sounds can be heard by a user. Sounds may be enhanced by the use of microphones, speakers, and other electronic equipment. The side ducts extend to the rear of the helmet and help to reduce drag and turbulence-induced vibration due to air flow. In another embodiment, separate air and sound ducts are located at each side of the helmet. The separate air and sound ducts function more efficiently because air and sound waves pass through different inlet ports and openings in the helmet. Breakaway joints may be used for the helmet. The breakaway joints provide increased protection for a user because the joints will break apart when the helmet is subjected to excessive forces, causing the air and sound ducts to break apart and separate from the rest of the helmet. The helmet has an adjustable face shield which may be moved forward or backward.

13 Claims, 5 Drawing Sheets

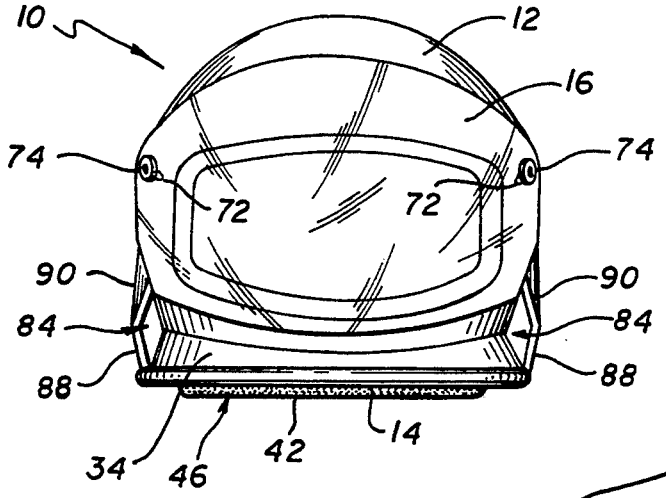
FIG. 6
FIG. 7
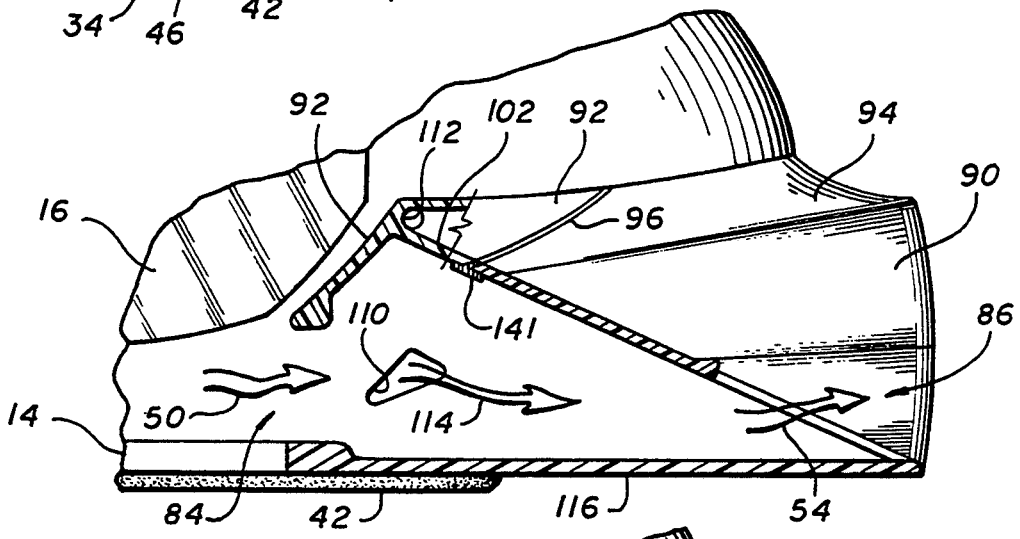
FIG. 8
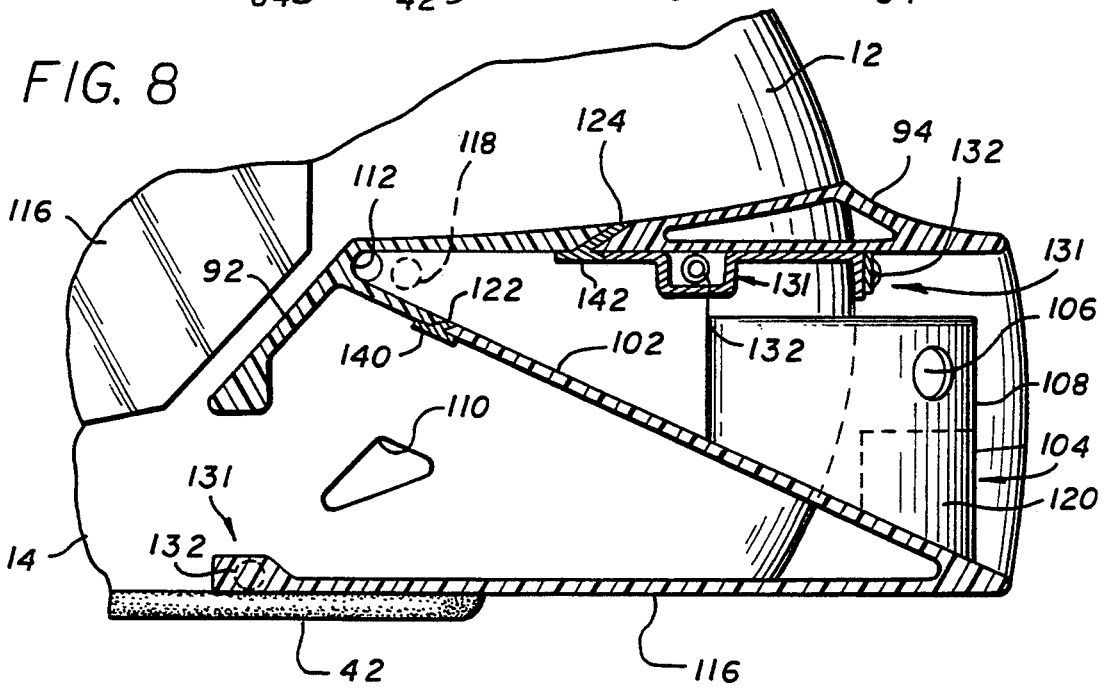

HELMET WITH SOUND DUCTS

BACKGROUND OF THE INVENTION

The present invention relates generally to helmets worn when driving a motorcycle or other vehicle, and more particularly to a helmet having air and sound ducts used to aspirate interior air from the helmet, and to enhance sound so that a wearer is better able to hear sounds, including rear sounds.

Heretofore, motorcycle riders have disliked wearing helmets, in part because of heat build-up within the helmet, and also because helmets cut down visibility to the side and rear and reduce the driver's sense of hearing, thus severely impairing the driver's ability to sense the presence of other vehicles on the road. The loss of hearing is particularly dangerous with regard to vehicles approaching from and/or shifting position to the rear of the motorcyclist, as rearward visibility of the motorcyclist is very poor.

In the past, a variety of different methods have been used to discharge air from within a helmet when driving a motorcycle or other vehicle. For example, U.S. Pat. No. 4,622,700, issued to Sundahl on Nov. 18, 1986, discloses a helmet having at least one opening in a medial portion thereof. Air flowing over the helmet acts to aspirate air from within the helmet, up through channels in the helmet's lining, and out through the opening in the helmet. U.S. Pat. No. 4,667,348, issued to Sundahl on May 26, 1987, describes a helmet which draws air inside the helmet through slits in a lower front portion near a wearer's chin and upward behind a face shield. The air exits at the top of the shield between the shield and helmet.

A helmet for use with motorcycles is disclosed in U.S. Pat. No. 4,519,099, issued to Kamiya, et al., on May 28, 1985. Air enters the helmet through air inlets at the top of the helmet, and then travels through channels in the helmet's lining, exiting at the rear of the helmet. Finally, U.S. Pat. No. 4,370,758, issued to Mattheis on Feb. 1, 1983, describes a helmet having devices attached to the sides of the helmet which attenuate noise generated from turbulence when the helmet passes through air. However, the helmet does not have openings in the helmet near a wearer's ears which would facilitate hearing sounds when the wearer is riding a bicycle or driving a motorcycle or vehicle.

None of the helmets disclosed in the above-mentioned patents effectively reduce drag and turbulence-induced vibration caused by air flowing over the helmets.

SUMMARY OF THE INVENTION

It is an object of the present invention to provide a helmet having air and sound ducts which may be used to discharge interior air from the helmet, and to enhance sounds so that a wearer is better able to hear sounds, including rear sounds.

It is another object of the present invention to provide a helmet which is capable of electronically enhancing sound.

It is still another object of the present invention to provide a helmet which reduces drag and turbulence-induced vibration caused by air flowing over the helmet.

It is still another object of the present invention to provide a helmet having joints which will break apart when subjected to excessive forces.

These and other objects and advantages are attained by a helmet worn when riding a bicycle or driving a motorcycle or vehicle. In one embodiment, a duct is located at each side of the helmet, and used for the dual functions of drawing air from the interior of the helmet and channeling ambient sounds inside the helmet where the sounds can be heard by a user. Sounds may be enhanced by the use of microphones, speakers, and other electronic equipment. The side ducts extend to the rear of the helmet and help to reduce drag and turbulence-induced vibration due to air flow.

In another embodiment, separate air and sound ducts are located at each side of the helmet. The separate air and sound ducts function more efficiently because air and sound waves pass through different inlet ports and openings in the helmet. Breakaway joints may be used for the helmet. The breakaway joints provide increased protection for a user because the joints will break apart when the helmet is subjected to excessive forces, causing the air and sound ducts to break apart and separate from the rest of the helmet. The helmet has an adjustable face shield which may be moved forward or backward.

In accordance with one aspect of the invention, a pair of microphones may be mounted on respective sides of the rear of the helmet, and are coupled to respective speakers within the helmet on the same sides as the microphones, used with or without ducting.

The various features of the present invention will be best understood together with further objects and advantages by reference to the following description of the preferred embodiments taken in conjunction with the accompanying drawings.

BRIEF DESCRIPTION OF THE DRAWINGS

FIG. 6 is a front elevational view of the helmet of FIG. 4;

FIG. 7 is an enlarged partial cross-sectional view of a rear portion of the helmet of FIG. 4 showing an air inlet port where air enters one of the air ducts and an exit or aspiration port where air exits the duct;

FIG. 8 is another enlarged partial cross-sectional view of the rear portion of the helmet of FIG. 4 showing breakaway joints used for the helmet;

DESCRIPTION OF THE PREFERRED EMBODIMENTS

The following specification taken in conjunction with the drawings sets forth the preferred embodiments of the present invention in such a manner that any person skilled in the art can use the invention. The embodiments of the invention disclosed herein are the best modes contemplated by the inventor for carrying out his invention in a commercial environment although it should be understood that various modifications can be accomplished within the parameters of the present invention.

Figure 1:
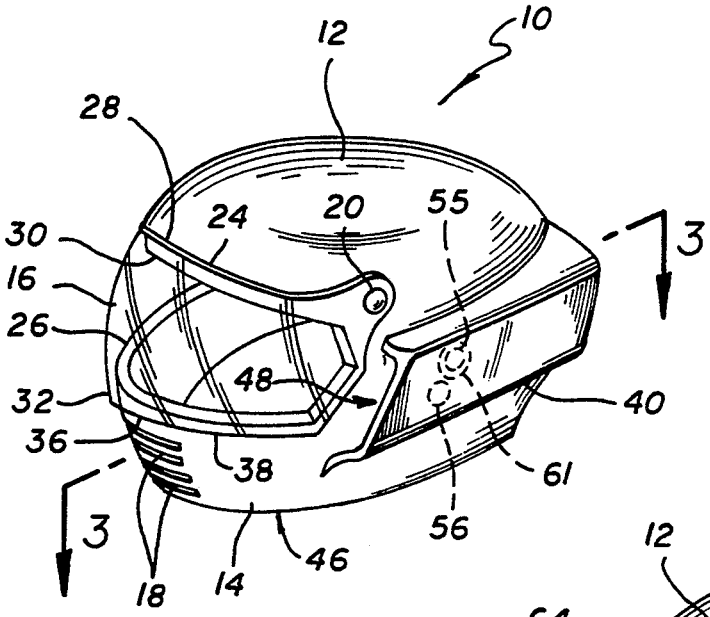
FIG. 1 is a front perspective view of a helmet having side ducts illustrating the principles of the present invention.
Figure 2:
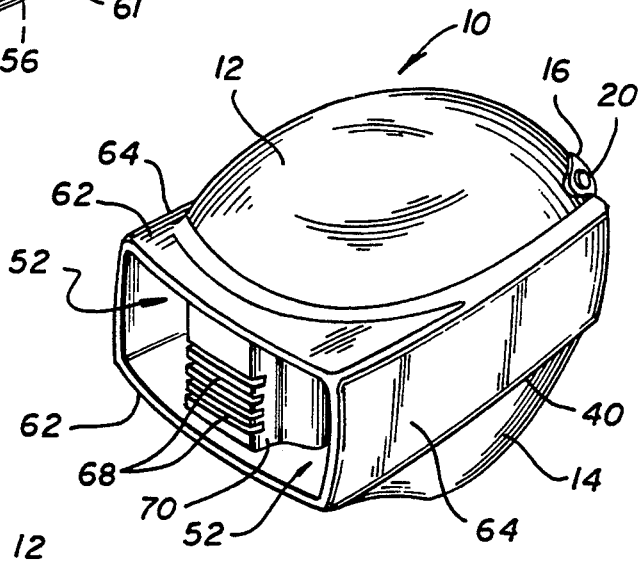
FIG. 2 is a rear perspective view of the helmet of FIG. 1.
Figure 3:
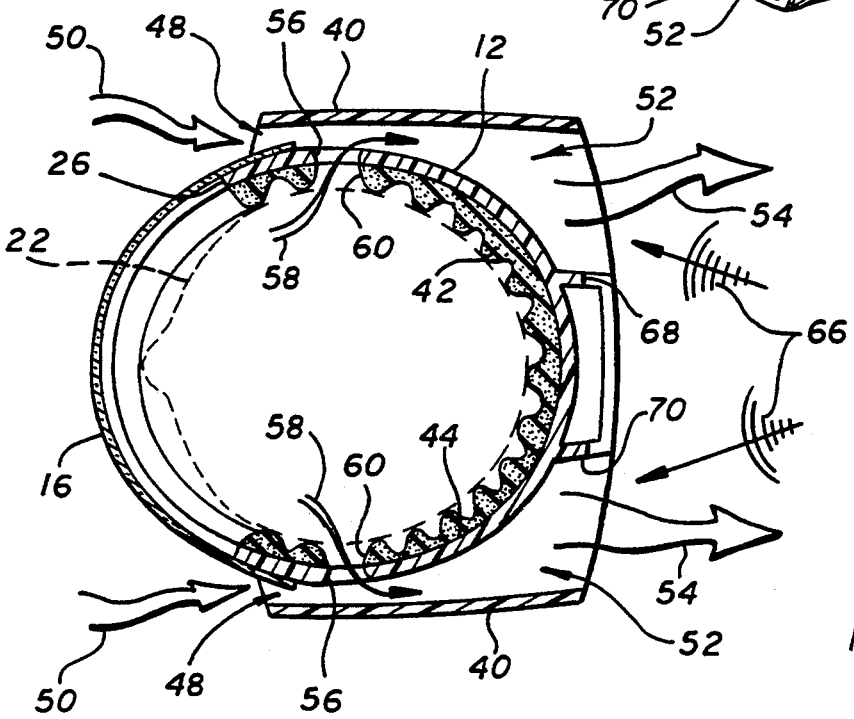
FIG. 3 is a cross-sectional view taken in the direction of arrows 3—3 shown in FIG. 1.

FIGS. 1 through 3 show a preferred embodiment of a helmet 10 of the present invention. The helmet 10 has a generally dome-shaped top portion 12 made out of a lightweight, structurally strong material, such as a fiber-reinforced high strength plastic. However, any suitable material may be used. The helmet 10 has a bottom portion 14 which extends around the chin area of a user near the front of the helmet 10 and continues past the ears of the user toward the rear of the helmet 10. Bottom portion 14 may be integrally formed with and made out of the same material used for the top portion 12, if desired.

The helmet 10 is generally shaped to fit a user's head 22 as shown in FIG. 3, and is placed over the head 22 using opening 46 at the bottom of the helmet 10. The helmet 10 has a liner 42 at an inside surface 44 thereof which is used to cushion the user's head 22. Liner 42 may be made out of any suitable elastomeric or foam material, such as styrofoam, polyurethane foam, or the like. However, any suitable material may be used for the liner 42.

The helmet 10 has a front opening 26 which allows a user to see to the front and side of the helmet 10. A face shield 16 made from a transparent material, such as polycarbonate, or the like, is pivotally coupled to top portion 12 at 20. The face shield 16 is generally shaped to match the dome shape of the top portion 12 near the top edge 24 of the face shield 16 in order to provide optimum air flow over the top portion 12. Edge 24 of the face shield 16 is preferably located toward the top area of the helmet 10 where maximum laminar air flow occurs in order to produce effective venturi aspiration through an elongated opening 28 between the face shield 16 near edge 24 and a top area 30 of portion 12 adjacent front opening 26 in the helmet 10.

Bottom portion 14 may have slots 18 therein, if desired, which allow air to enter the helmet 10 for aspiration through opening 28. Also air may enter the helmet 10 through opening 46 at the bottom of the helmet 10, or through an elongated opening 32 between the face shield 16 (near bottom edge 36 thereof) and a bottom area 38 of portion 14 adjacent front opening 26 of the helmet 10. As such, air may be drawn inside the helmet 10 through slots 18, opening 46, and/or elongated opening 32, and aspirated out of the helmet 10 through elongated opening 28 near top edge 24 of the face shield 16.

The helmet 10 has side ducts 40 attached thereto, or integrally formed with, the helmet 10. The side ducts 40 have front inlet ports 48 through which air enters the ducts 40, as illustrated by arrows 50 shown in FIG. 3, when the helmet 10 is being used with a bicycle, motorcycle or vehicle, and exits or is aspirated out of the helmet 10 through rear exits or aspiration ports 52, as illustrated by arrows 54 shown in FIG. 3. As air moves through the side ducts 40, a venturi effect (or Bernouli effect) occurs which causes air inside the helmet 10 to be drawn out of the helmet 10 through openings 56 in top portion 12, as illustrated by arrows 58 in FIG. 3. Note that corresponding openings 60 exist in the liner 42 which provide access to the openings 56. In addition, the liner 42 has channels therein (not shown) for channeling air from inside the helmet 10 through openings 56 and 60. As such, the ducts 40 provide an efficient means of aspirating or drawing air from inside the helmet 10.

The side ducts 40 have top and bottom portions 62 and side portions 64 which extend to the rear of the helmet 10 past the top portion 12. The rearwardly extending members or portions 62 and 64 act like a "spoiler" reducing air drag and turbulence-induced vibration at high speed at the rear of the helmet 10. As such, the rearwardly extended shape of the side ducts 40 provides more efficient air flow at the rear of the helmet 10.

The side ducts 40 also enhance ambient sounds generally represented by arrows 66 shown in FIG. 3 so that a user or wearer of the helmet 10 is better able to hear such sounds, including sounds coming from the rear of the helmet 10. The sound waves travel through the side ducts 40 (entering through ports 48 and/or 52), and pass inside the helmet 10 through openings 55 in top portion 12 at both sides of the helmet 10 and corresponding openings 61 in the liner 42 where the sounds are heard by a user. Preferably, openings 61 in the liner 42 are large enough or have contoured adjacent surfaces to allow a user to fit his or her ears into the openings 61 for more efficient sound transmission. Also, inserts (not shown) may be inserted into openings 55 and/or 61 for the purpose of directing or channeling sounds into the user's ears. As a result, the side ducts 40 provide the dual functions of aspirating or discharging air from inside the helmet 10, and of enhancing or improving a user's ability to hear ambient sounds outside the helmet 10, including rear sounds.

Figure 5:
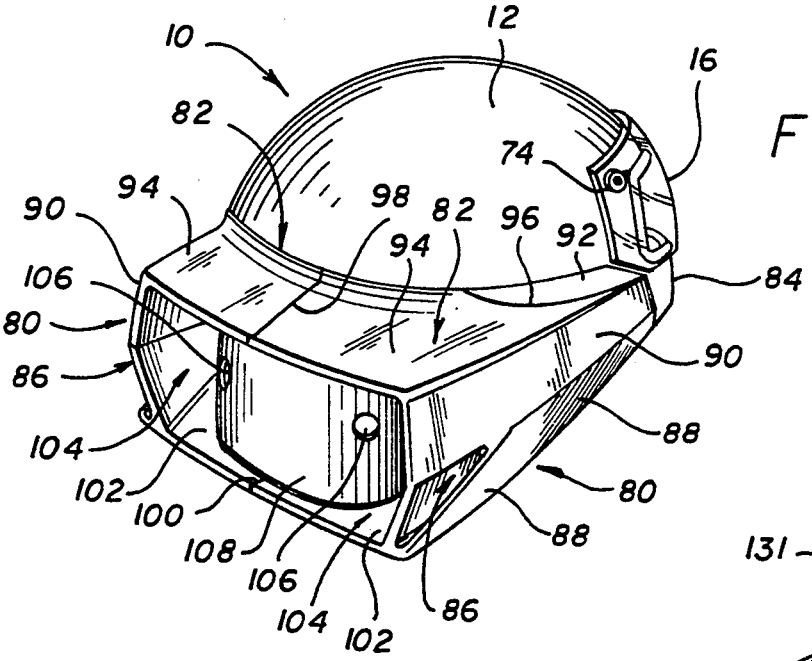
FIG. 5 is a rear perspective view of the helmet of FIG. 4 showing microphones at the rear of the helmet.
Figure 14:
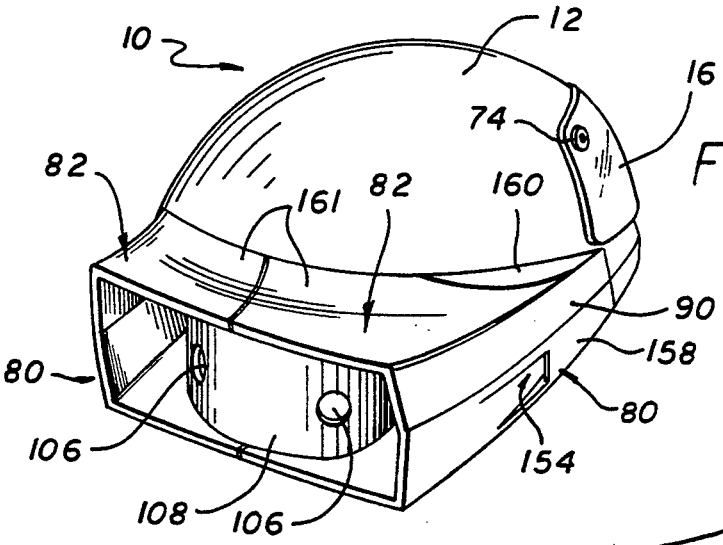
FIG. 14 is a rear perspective view of the helmet of FIG. 13 showing microphones at the rear of the helmet.

Sound may be electronically enhanced, if desired, and a microphone grill 68 is provided in a rear, hollow enclosure 70 which may be used to hold microphones, batteries or other electronic equipment (not shown, but see FIGS. 5, 8 and 14). Also, small speakers (not shown, but see numeral 118 in FIG. 8) may be provided inside the helmet 10 near a wearer's ears. It is important to note that such microphones, batteries, speakers, or other electronic equipment may be located at any desirable locations inside or outside the helmet 10.

The side ducts 40 provide additional protection against objects that may strike the side of the helmet 10. As such, the side ducts 40 provide additional structures or barriers to cushion or resist forces from such objects, and prevent penetration of such objects through openings 55 and 56.

FIGS. 4 through 8 show another preferred embodiment of the helmet 10. The face shield 16 has an elongated slot 72 therein (preferably horizontal). A fastener 74 engages slot 72 so that the shield 16 may be pivoted about fastener 74, as illustrated by arrows 76, shown in FIG. 4. The shield 16 may also be moved forward or backward using elongated slot 72, when moved forward, elongated openings 28 and 32 exist between the shield 16 and areas 30 and 38 adjacent opening 26 in the helmet 10. As discussed above, openings 28 and 32 facilitate aspirating air from inside the helmet 10. Note that top edge 24 of the shield 16 shown in FIG. 4 extends above opening 26 toward the top of the helmet 10 where maximum laminar air flow exits, providing excellent venturi effect for air aspiration through elongated opening 28.

When the face shield 16 is moved backward or toward the rear of the helmet 10, openings 28 and 32 close as an inside surface 78 of the shield 16 comes into contact with areas 30 and 38. The shield 16 may be moved backward, closing openings 28 and 32, to protect a user's face from rain, or the like, and to reduce ventilation in cold weather. It is important to note that the shield 16, shown in FIG. 4 and described above, may be used with any other embodiment of the helmet 10 disclosed in this specification. Also, any feature of any embodiment disclosed herein may be incorporated into and used with any other embodiment of the helmet 10.

Figure 4:
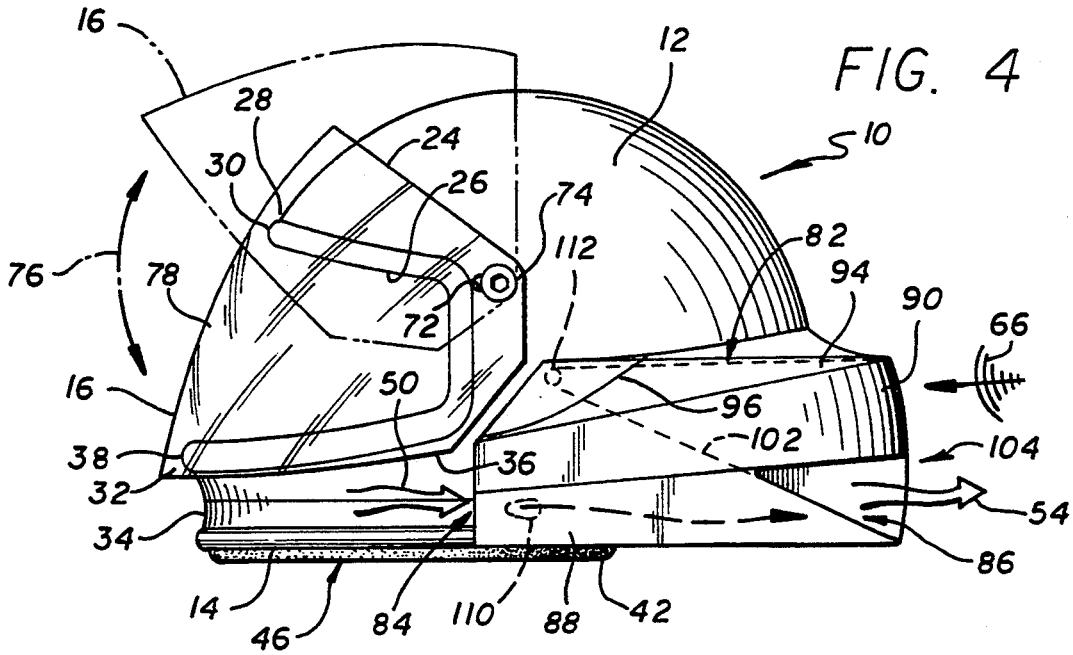
FIG. 4 is a side elevational view of another embodiment of the helmet having separate air and sound ducts at the sides of the helmet and air aspiration ports at the rear of the helmet.

The helmet 10 shown in FIGS. 4 through 8 has separate air and sound ducts 80 and 82, respectively, at both sides of the helmet 10. The air ducts 80 are formed by side members 88 and 90, bottom member 116, inclined member 102, and bottom portion 14 (see FIGS. 5 through 7). The air ducts 80 have front inlet ports 84 through which air enters the ducts 80, as illustrated by arrows 50 in FIGS. 4 and 7. Concave surfaces 34 are provided in bottom portion 14 as shown in FIGS. 4 and 6. The concave surfaces 34 help to direct or channel the air into the entry ports 84. Air exits or is aspirated out of the air ducts 80 at rear exit ports 86, as illustrated by arrows 54 shown in FIGS. 4 and 7. The air moving through the air ducts 80 produces a venturi effect which draws air from inside the helmet 10 through openings 110 in the top portion 12 and into the air ducts 80 for discharge through exit ports 86. Openings 110 have corresponding openings in the liner 42 like openings 60 shown in FIG. 3.

The sound ducts 82 are formed by side member 90, top members 92 and 94, and inclined member 102. The sound ducts 82 are separated from the air ducts 80 by inclined member 102. Ambient sound waves, represented by arrow 66 shown in FIG. 4, enter the sound ducts 82 through rear inlet ports 104, travel up the ducts 82 and pass inside the helmet 10 through openings 112 in the top portion 12. The openings 112 are located near a user's ears, and have openings in the liner 42 like openings 61 shown in FIG. 1. The sound ducts 82 have a progressively reduced cross-section as the sound waves 66 move up the ducts 82 toward openings 112. As such, the progressively decreasing cross-section of the ducts 82 channels the sound waves 66 toward openings 112.

As discussed previously, sound may be enhanced by microphones 106 contained in a rear enclosure 108. Batteries and/or other electronic equipment, generally indicated by numeral 120 in FIG. 8, may be used with the helmet 10. Also, speakers 118 may be positioned inside the helmet 10 near a user's ears, if desired (see FIG. 8).

It is important to note that the helmet 10 may be used without air and/or sound ducts, and with only microphones 106, speakers 118 and other electronic equipment located inside or outside the helmet 10. As such, a helmet 10 with such sound enhancing electronic equipment and without air and/or sound ducts provides another embodiment of the invention. Preferably, each microphone 106 at one side of the helmet 10 has a corresponding speaker 118 at the same side of the helmet 10. However, only one microphone 106 may pass sounds to one or more speakers 118, or two microphones 106 may pass sounds to only one speaker 118.

The air and sound ducts 80 and 82 function more efficiently because the ducts are separated. Increased efficiency results because air and sound waves pass through different openings 110 and 112 in the top portion 12.

Figure 9:
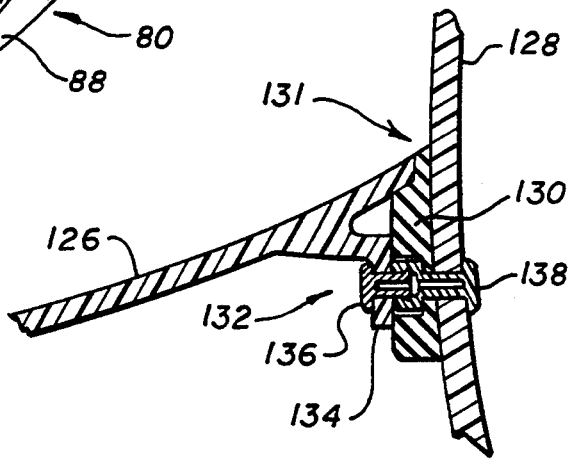
FIG. 9 is an enlarged detailed view of one of the breakaway joints used for the helmet.

Breakaway joints 131 are used so that air and sound ducts 80 and 82 will break apart and separate from the rest of the helmet 10 when the helmet 10 is subjected to excessive forces, providing increased protection for a user. A detailed view of one of the breakaway joints 131 is shown in FIG. 9. Numeral 126 represents a breakaway panel that is connected by a breakaway joint 131 to a more fixed structural panel or part 128 such as top portion 12 of the helmet 10.

Gasket 130 shown in FIG. 9 is used to cushion panel 126 against panel 128. Structural adhesive, such as epoxy, or the like, is used to fasten gasket 130 to either panel 126 or panel 128. A snap fastener 132 such as fasteners sold by The Stimpson Co., Inc., may be used to fasten panel 126 to panel 128 at flange 134. However, any suitable snap fastener may be used. Such a snap fastener 132 uses two members 136 and 138 which snap or fasten together, but break apart when excessive forces are encountered. As such, the breakaway joint 131 will break apart when subjected to excessive forces, but can be reassembled by snapping members 136 and 138 together again.

FIG. 8 shows how snap fasteners 132 may be used for different breakaway joints 131 of the helmet 10. In addition, gaskets 140, 141 and 142, shown in FIGS. 7 and 8, are used to fit together at 122, 96, and 124, respectively, the ends of different breakaway panels to the ends of different fixed panels. Each of gaskets 140, 141 or 142 is fastened to either a breakaway panel or to a fixed panel. As a result, the ends of the breakaway panels and fixed panels at 96, 122 and 124 are free to separate when the breakaway joints 131 break apart.

As discussed previously, members 88, 90, 94, 102 and 116 extend to the rear of the helmet 10 and reduce drag and turbulence-induced vibration due to air flow. The embodiments described in the following discussion also reduce drag and vibration.

Figure 10:
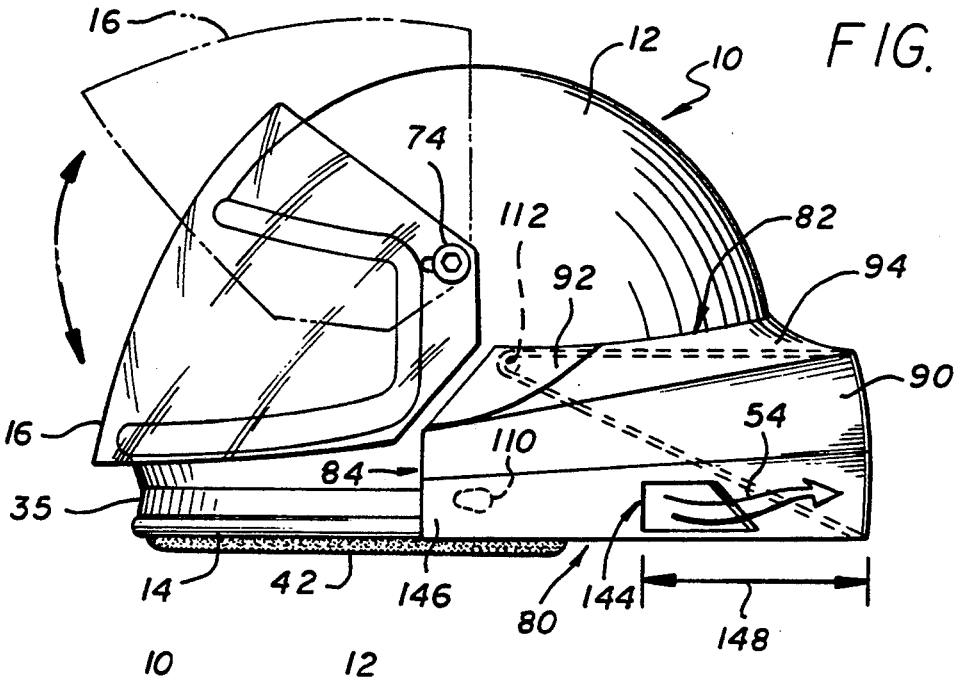
FIG. 10 is a side elevational view of another embodiment of the helmet having separate air and sound ducts at the sides of the helmet and air aspiration ports located a distance forward of the rear of the helmet.
Figure 11:
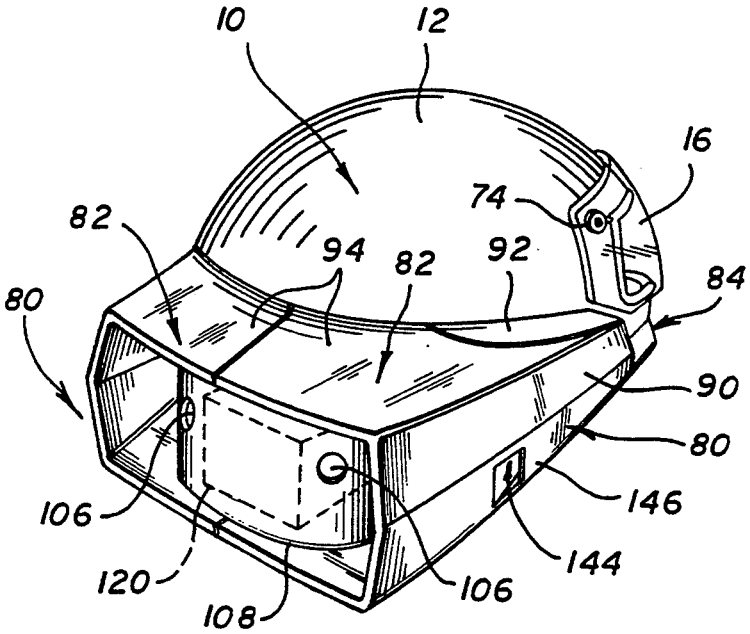
FIG. 11 is a rear perspective view of the helmet of FIG. 10 showing microphones at the rear of the helmet.
Figure 12:
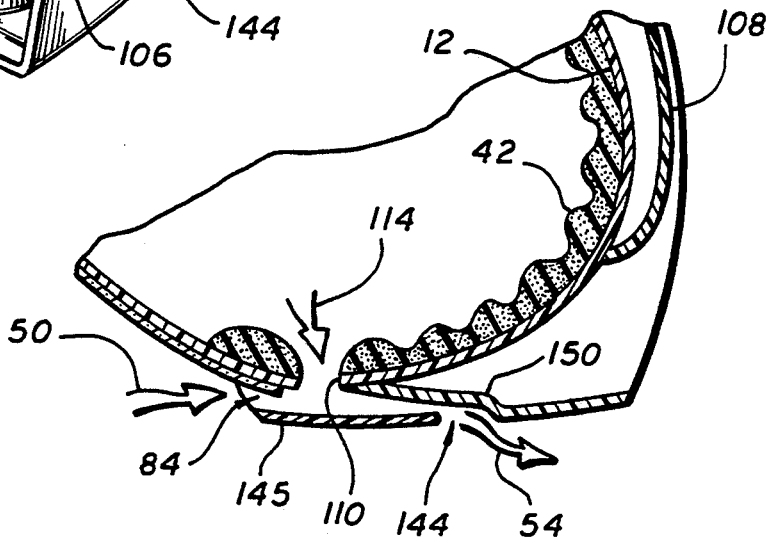
FIG. 12 is an enlarged, detailed, partial cross-sectional view of the air and sound ducts at one side of the helmet of FIG. 10 illustrating how air enters the air duct through inlet ports and exits through one aspiration port.

Another embodiment of the helmet 10 is shown in FIGS. 10 through 12. This helmet 10 is generally the same as the helmet shown in FIGS. 4 through 6 except an exit port 144 in member 146 of each air duct 80 is located a distance 148 from the rear of portion 12 of helmet 10 toward the front of the helmet 10. Distance 148 preferably equals less than 25 percent of the horizontal length of the dome-shaped portion 12 of the helmet 10.

FIG. 12 shows how members 150 at both air ducts 80 also help to channel air flow down the ducts 80 in order to produce a desirable venturi effect used to draw air from inside the helmet 10 as discussed above.

Figure 13:
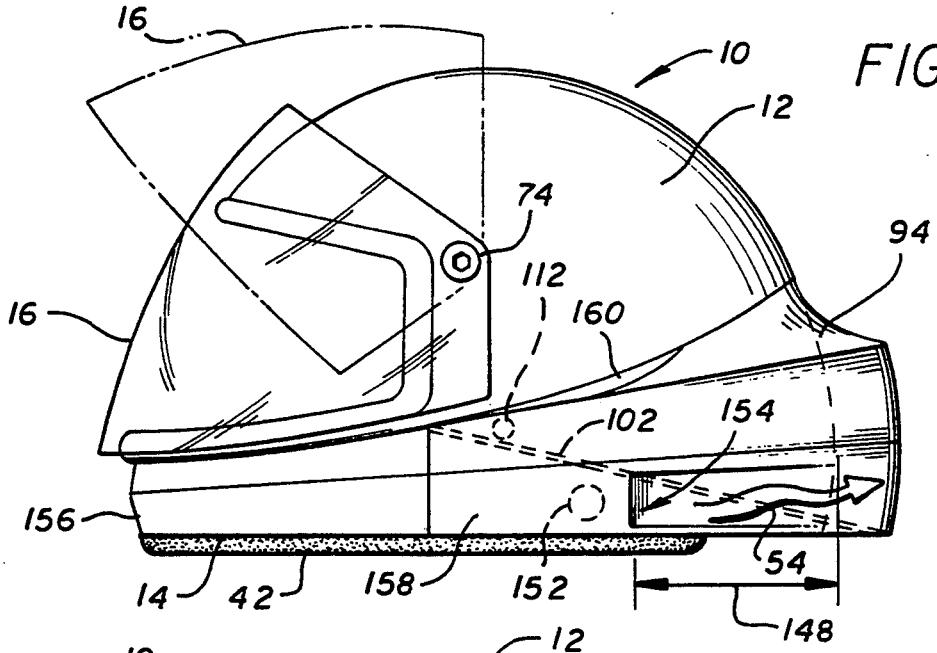
FIG. 13 is a side elevational view of another embodiment of the helmet having separate air and sound ducts at the sides of the helmet and air aspiration ports located a distance forward of the rear of the helmet.
Figure 15:
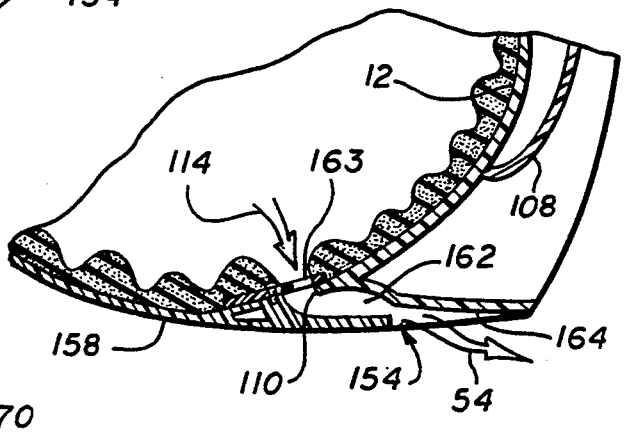
FIG. 15 is an enlarged, detailed, partial cross-sectional view of the air and sound ducts at one side of the helmet of FIG. 13 illustrating how air enters the air duct through only one inlet port and exits through one aspiration port.

FIGS. 13 through 15 disclose another embodiment of the helmet 10. The embodiment of the helmet 10 is generally the same as the embodiment of FIGS. 10 and 11 except each air duct 80 of the helmet does not have an air inlet port, openings 152 in portion 12 are located closer to air exit ports 154 of the ducts 80, different size top members 160 and 161 are used, and the bottom portion 14 has convex surfaces 156.

Distance 148 (see FIG. 13) equals about less than 25 percent of the horizontal length of the dome-shaped portion 12 of the helmet 10. The convex surfaces 156 provide better air flow around the bottom portion 14 of the helmet 10. In addition, member 162 and outer surface 164 of member 158 used for air ducts 80 are shaped to provide a better venturi effect.

Figure 16:
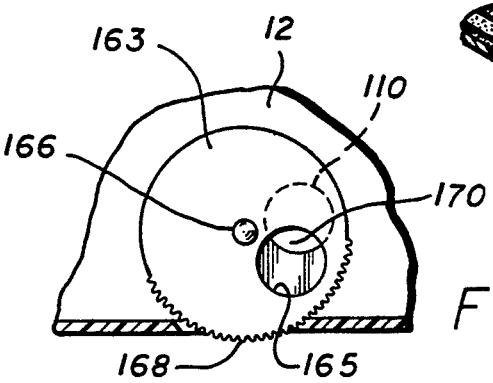
FIG. 16 is an enlarged detailed view of a rotating disc used to control air flow out of the helmet.

FIGS. 15 and 16 show a rotating disc 163 which may be used to control air flow out of the helmet 10 through opening 110. The disc 163 is rotatably mounted to portion 12 at 166 and preferably has a knurled portion 168 which extends below the helmet 10 and may be used by a user to rotate the disc 163. The disc 163 has an opening 165 therein which may be used to allow air to pass out of the helmet through space 170 when openings 110 and 165 are oriented as shown in FIG. 16. Space 170 may be increased or decreased in size by rotating the disc 163 to control air flow coming out of the helmet 10.

The above description discloses the preferred embodiments of the present invention. However, persons of ordinary skill in the art are capable of numerous modifications once taught these principles. By way of example and not limitation, the helmet may be used with or without breakaway joints, and the helmet may be used with only an air duct, or only a sound duct. Microphones, speakers, or other electronic equipment may be located anywhere inside or outside the helmet, and the microphone and speakers may be used with two air ducts, or one or no air ducts. Accordingly, it will be understood by those skilled in the art that changes in form and details may be made to the above-described embodiments without departing from the spirit and scope of the invention.

I claim:

1. A helmet for use with a bicycle, motorcycle or other vehicle, and having a front and a rear, said helmet comprising:

a shell of high strength shock resistant material, and having sides and an opening at the front of said shell allowing a user to see outside said shell, said shell having an inside and an outside., and said sides of said shell extending down over the ears of the user;

a resilient protective layer lining the inside of said shell;

a sound duct on each of said sides of said shell;

each of said sound ducts having an input opening facing to the rear of said helmet from said shell;

means including an opening from each said sound duct through the protective layer, toward the user's ears for directing sounds from behind the helmet to the user's ears;

said input opening being substantially greater in cross-sectional area than the opening through to the user's ears, and the duct being reduced in cross-section from said input opening to said opening to the user's ears.

2. A helmet for use with a bicycle, motorcycle or other vehicle, and having a front and a rear, said helmet comprising:

a shell having sides, an opening at a front of said shell allowing a user to see outside said shell and an opening at each of said sides, said shell having an inside and an outside, and said sides of said shell extending down over the ears of the user;

single means attached to each of said sides of said shell and outside said shell for drawing air from inside said shell through said openings at said sides, and for channeling ambient sound waves from outside said shell to inside said shell where said sound waves are heard by a user;

said means including a duct on each side of said shell opening to the rear of said helmet and having an opening from said duct to the vicinity of the user's ears; and each said duct having a progressively reduced cross-section in a forward direction toward said opening in said shell inside said duct.

3. A helmet for use with a bicycle, motorcycle or other vehicle, and comprising a front and a rear, said helmet comprising:

a shell having sides and an opening at a front of said shell allowing a user to see outside said shell;

a sound duct on each of said sides of said shell;

each of said sound ducts having an input opening facing to the rear from said shell; and means including an opening from each sound duct through the shell for directing sounds from behind the helmet to the vicinity of the user's ears; and said input opening being substantially greater in cross-sectional area than the opening through the shell, and the duct being gradually reduced in cross-section from said input opening to said opening through said shell.

4. A helmet as defined in claim 1 wherein said sound ducts are smoothly and progressively reduced in cross section.

5. A helmet as defined in claim 1 wherein said helmet has a central front to rear axis, and wherein the periphery of each of the sound duct input openings defines a plane which is more nearly perpendicular to, than it is parallel to said axis.

6. A helmet as defined in claim 1 wherein said helmet has a central front to rear axis, and wherein the periphery of each of said sound duct openings defines a plane which is substantially perpendicular to said axis.

7. A helmet as defined in claim 1 wherein each said sound duct only has a single input opening.

8. The helmet of claim 2 wherein said means for drawing air and channeling sound waves includes means for reducing drag and vibration due to air flow at a rear of said helmet, said means comprising a generally squared-off configuration at the rear of said helmet.

9. The helmet of claim 2 further comprising a face shield pivotally mounted to said shell, said face shield being spaced from said shell at the top of said face shield to form an opening between a top of said face shield and said shell located at a top portion of said shell where maximum laminar air flow occurs.

10. The helmet of claim 2 wherein each of said means for drawing air and channeling sound waves comprises a separate air duct and a separate sound duct attached to each side of said shell and a corresponding opening in said shell located inside each of said air and sound ducts, the opening from each said sound duct being adjacent the ears of the user, and the opening from each said air duct being spaced substantially away from the opening from each said sound duct.

11. The helmet of claim 3 wherein said helmet has at least one breakaway joint adapted so that said joint will break apart when subjected to excessive forces.

12. A helmet as defined in claim 1 wherein each said sound duct opens only toward the rear of said helmet.

13. A helmet as defined in claim 1 wherein said ducts provide a substantially squared off configuration to the rear of said helmet.

* * * * *